US007978090B2

(12) United States Patent
Brooks et al.

(10) Patent No.: US 7,978,090 B2
(45) Date of Patent: Jul. 12, 2011

(54) APPARATUS, SYSTEM, AND METHOD FOR SAFELY AND SECURELY STORING MATERIALS

(75) Inventors: Bradford O. Brooks, Longmont, CO (US); Larry M. Ernst, Longmont, CO (US); Joan L. Mitchell, Longmont, CO (US)

(73) Assignee: International Business Machines Corporation, Armonk, NY (US)

( * ) Notice: Subject to any disclaimer, the term of this patent is extended or adjusted under 35 U.S.C. 154(b) by 278 days.

(21) Appl. No.: 12/112,976

(22) Filed: Apr. 30, 2008

(65) Prior Publication Data

US 2009/0273472 A1 Nov. 5, 2009

(51) Int. Cl.
*G08B 21/00* (2006.01)

(52) U.S. Cl. ..... 340/665; 340/666; 323/904; 343/853; 343/893; 345/173

(58) Field of Classification Search ..... 340/687, 340/666, 521, 541, 540, 568.1, 686.1, 565, 340/5.52, 5.8, 665; 307/119, 116; 702/41, 702/139; 361/170, 189; 323/904; 343/853, 343/893; 345/173

See application file for complete search history.

(56) References Cited

U.S. PATENT DOCUMENTS

| | | | | |
|---|---|---|---|---|
| 6,515,586 | B1 * | 2/2003 | Wymore | 340/541 |
| 6,650,779 | B2 * | 11/2003 | Dorrity et al. | 382/228 |
| 6,909,373 | B2 | 6/2005 | Power et al. | |
| 2004/0222896 | A1 * | 11/2004 | Power et al. | 340/687 |
| 2006/0055543 | A1 * | 3/2006 | Ganesh et al. | 340/573.1 |
| 2006/0077172 | A1 * | 4/2006 | Fukumoto et al. | 345/156 |
| 2006/0171570 | A1 * | 8/2006 | Brendley et al. | 382/115 |
| 2006/0202832 | A1 * | 9/2006 | Reznik et al. | 340/572.7 |
| 2006/0273903 | A1 * | 12/2006 | Kim et al. | 340/572.1 |
| 2007/0040034 | A1 * | 2/2007 | Hennick et al. | 235/462.41 |
| 2007/0069021 | A1 | 3/2007 | Elrod et al. | |
| 2007/0171058 | A1 * | 7/2007 | Knowles et al. | 340/565 |
| 2007/0177770 | A1 * | 8/2007 | Derchak et al. | 382/115 |
| 2007/0241881 | A1 * | 10/2007 | Golden | 340/521 |
| 2008/0055101 | A1 * | 3/2008 | Chung | 340/686.1 |
| 2009/0195401 | A1 * | 8/2009 | Maroney et al. | 340/686.6 |

FOREIGN PATENT DOCUMENTS

WO WO 2005071597 A1 8/2005

* cited by examiner

*Primary Examiner* — George A Bugg
*Assistant Examiner* — Hoi C Lau
(74) *Attorney, Agent, or Firm* — Kunzler Needham Massey & Thorpe

(57) ABSTRACT

An apparatus, system, and method are disclosed for safely and securely storing materials. A plurality of smart tiles sense traffic and generate traffic data. A network transmits the traffic data from the smart tiles. A computer determines a plurality of normal traffic patterns from the traffic data. In addition, the computer detects an abnormal traffic pattern from the traffic data. The computer activates a security response in response to the abnormal traffic pattern.

19 Claims, 6 Drawing Sheets

APPARATUS, SYSTEM, AND METHOD FOR SAFELY AND SECURELY STORING MATERIALS

BACKGROUND

1. Field

This invention relates to storing materials and more particularly relates to safely and securely storing materials.

2. Description of the Related Art

Laboratory environments frequently include chemical, biological, nuclear, radiological, and explosive (CBNRE) materials. CBNRE materials are of potential interest to terrorists, criminals, and others wishing to obtain these restricted materials. As a result, it is important that CBNRE materials are stored securely.

Laboratories often employ a "once before entry" challenge security system. Personnel must enter a password, submit to biometric identification, or otherwise identify themselves before receiving access to areas with CBNRE materials.

Unfortunately, restrictions to accessing areas of the laboratory often results in reduced safety. For example, lockable doors make it more difficult to spot an injured person and/or to enter a laboratory area to rescue the injured person.

SUMMARY

From the foregoing discussion, there is a need for an apparatus, system, and method for safely and securely storing materials. Beneficially, such an apparatus, system, and method would automatically detect abnormal traffic patterns using smart tiles and activate a security response. The apparatus, system, and method would also allow a door to a laboratory to be left open to preserve line of sight safety while protecting CNBRE materials.

The present invention has been developed in response to the present state of the art, and in particular, in response to the problems and needs in the art that have not yet been fully solved by currently available methods for safely and securely storing materials. Accordingly, the present invention has been developed to provide an apparatus, system, and method for safely and securely storing materials that overcome many or all of the above-discussed shortcomings in the art.

The apparatus to safely and securely store materials is provided with a plurality of modules configured to functionally execute the steps of providing a security response, sensing traffic and generating traffic data, transmitting the traffic data, determining a plurality of normal traffic patterns, detecting an abnormal traffic pattern, and activating the security response. These modules in the described embodiments include a security module, a plurality of smart tiles, a network, and a computer.

The security module provides a security response. The plurality of smart tiles sense traffic and generate traffic data. The network is in communication with the smart tiles and the computer. The network transmits the traffic data from the smart tiles to the computer. The computer determines a plurality of normal traffic patterns from the traffic data, detects an abnormal traffic pattern from the traffic data, and activates the security response in response to the abnormal traffic pattern.

A system of the present invention is also presented to safely and securely storing materials. In particular, the system in one embodiment includes a storage volume, a security module, a plurality of smart tiles, a network, and a computer.

The security module comprises a lock disposed on the storage volume. The security module provides a security response of locking the storage volume. Each smart tile comprises a strain gauge. The strain gauge is in communication with a polymer surface. The smart tile senses traffic and generates traffic data. The traffic data comprises data sets with a position, a rate, and a time.

The network is in communication with the smart tiles and the computer. The network transmits the traffic data from the smart tiles to the computer. The computer determines a plurality of normal traffic patterns from the traffic data, detects an abnormal traffic pattern from the traffic data, and activates the security response in response to the abnormal traffic pattern.

A method of the present invention is also presented for safely and securely storing materials. The method in the disclosed embodiments substantially includes the steps to carry out the functions presented above with respect to the operation of the described apparatus and system. In one embodiment, the method includes generating traffic data, transmitting the traffic data, determining a plurality of normal traffic patterns, detecting an abnormal traffic pattern, and activating a security response.

A plurality of smart tiles sense traffic and generate traffic data. A network transmits the traffic data from the smart tiles. A computer determines a plurality of normal traffic patterns from the traffic data. In addition, the computer detects an abnormal traffic pattern from the traffic data. The computer activates a security response in response to the abnormal traffic pattern.

References throughout this specification to features, advantages, or similar language do not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The present invention provides an apparatus, a system, and a method for safely and securely storing materials. Beneficially such an apparatus, system, method would allow for example, the door to a laboratory to be left open to preserve line of sight safety while protecting CNBRE materials. Additionally, the apparatus, system, and method would support visual spotting an injured person and allow one or more rescuing staff members to enter a laboratory area to rescue the injured person, reduce restrictions to access areas of the laboratory due to lockable doors, and immediately lock a storage volume storing CNBRE materials in case of an abnormal traffic pattern. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Many of the functional units described in this specification have been labeled as modules, in order to more particularly emphasize their implementation independence. Modules may include hardware circuits such as one or more processors with memory, Very Large Scale Integration (VLSI) circuits, gate arrays, programmable logic, and/or discrete components. The hardware circuits may perform hardwired logic functions, execute computer readable programs stored on tangible storage devices, and/or execute programmed functions. The computer readable programs may in combination with a computer system perform the functions of the invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
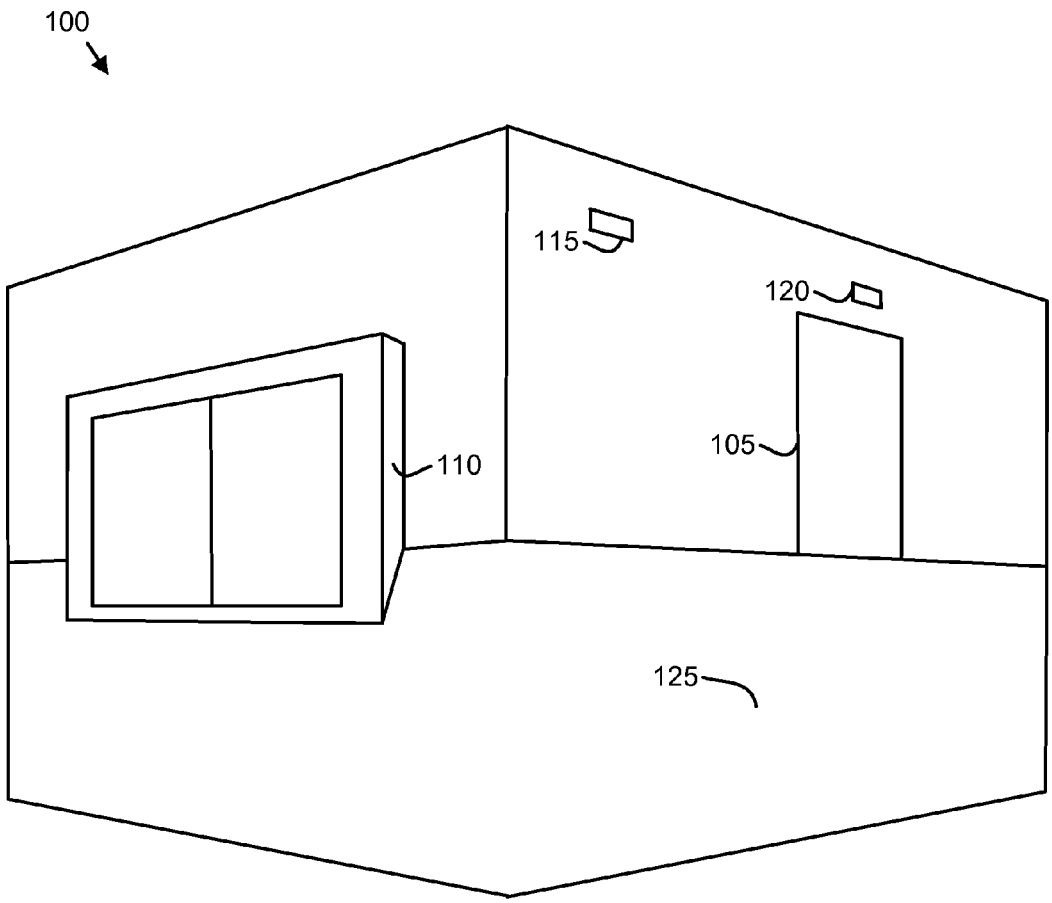
FIG. 1 is a drawing illustrating one embodiment of a room for storing CNBRE materials in a laboratory environment in accordance with the present invention.

FIG. 1 is a drawing illustrating one embodiment of a room 100 for storing CNBRE materials in a laboratory environment in accordance with the present invention. The room 100 includes a door 105, a storage volume 110, a camera 115, an alarm module 120, and a floor 125. Although for simplicity, only one door 105, one storage volume 110, one camera 115, and one alarm module 120 are shown, any number may be employed in the room 100.

A security system such as a once before entry challenge, a binary go or no go access, or the like may be employed at the door 105 of the room 100 of the laboratory environment. Persons must enter a password, submit to biometric identification, or otherwise identify themselves before receiving access.

The door 105 of the room 100 may be self-closing or self-opening. In addition, the door 105 may or may not be self-lockable. A computer may verify the entered password or biometric identification, match stored data such as a photo, a video, or the like, or employ any other method for verification of the identification as is well known to those of skill in the art. The door 105 may allow access to the room 100 on verification of the identification of the person that wishes an access. For example, the door 105 may self-open, if the identification of the person accessing the room 100 is verified. The door 105 may be self-locked, if the identification of the person accessing the room 100 is not verified.

The storage volume 110 may provide proper storage conditions, for example, temperature, pressure, humidity, and/or the like for storing CNBRE materials. The storage volume 110 may be designed in a way that the storage volume 110 may lock or unlock itself. For example, one or more doors of the storage volume 110 may automatically lock or unlock in response to an instruction and/or a signal from the computer within very short span of time such as one millisecond.

The camera 115 may capture and record video and/or photograph outdoors and/or inside of the room 100. In addition, the camera 115 may communicate with the computer to store the captured and recorded photos and/or videos. For example, the camera 115 may capture and record one or more videos and/or photographs of the persons accessing the room 100 and communicate with the computer to store the captured and recorded videos and/or photographs in a hard disk of the computer. The computer may use the stored videos and/or photographs for verification of the identification of persons accessing the room 100 in future course of working of the security system.

The alarm module 120 may raise an audio and/or a visual alarm, if identity of the person accessing the room 100 that stores the CNBRE materials is not verified. For example, the alarm module 120 may include one or more speakers to raise the audio alarm and/or one or more display screens to raise the visual alarm at one or more places.

Figure 2:
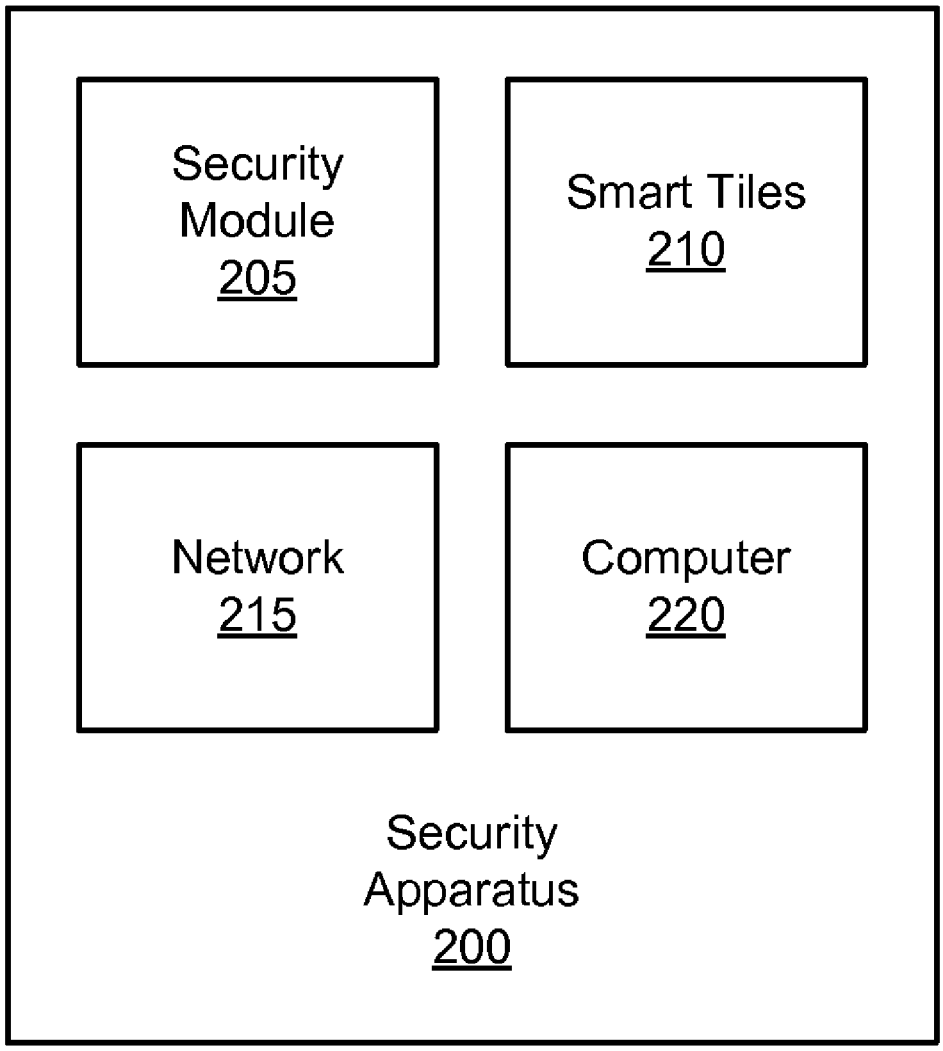
FIG. 2 is a schematic block diagram illustrating one embodiment of a security apparatus for safely and securely storing materials of the present invention.

FIG. 2 is a schematic block diagram illustrating one embodiment of a security apparatus 200 for safely and securely storing materials of the present invention. The apparatus 200 may be embodied in the room 100 of FIG. 1. The apparatus 200 includes a security module 205, a plurality of smart tiles 210, a network 215, and a computer 220. The description of apparatus 200 refers to elements of FIG. 1, like numbers referring to like elements. Although for simplicity, only one security module 205, one network 215, and one computer 220 are shown, any number may be employed in the apparatus 200.

The floor 125 of the room 100 may comprise the plurality of smart tiles 210. The plurality of smart tiles 210 sense traffic and generate traffic data. Each smart tile 210 may comprise a sensing device in communication with a smart tile surface. In an embodiment, the smart tile 210 comprises a strain gauge in communication with a polymer surface.

The traffic data may comprise data sets each with a position, a rate, and a time. For example, the traffic data may comprise thousands of data sets each comprising the respective position of laboratory personnel, carts, and/or the like moving and/or stacked on the floor 125, the rate of movement of laboratory personnel, carts, and/or the like, and the time at which the plurality of tiles 210 sense and generate the traffic data.

In an embodiment, each data set further comprises a weight and an impact. For example, each data set may further comprise the weight of laboratory personnel, carts, and/or the like moving and/or stacked on the floor 125 and the impact produced on the floor 125 due to any type of movement for example, vertical horizontal or a combination thereof of the laboratory personnel, carts, and/or the like.

In a particular example, the traffic data may comprise the data set with a first laboratory personnel in the center of the room 100 moving at a rate of two (2) kilometers per hour and a second laboratory personnel standing in one corner of the room 100 at nine (9) AM. Continuing with the example above, the data set may further comprise the weight of the value of sixty (60) and sixty five (65) kilograms of the first and second laboratory personnel and the impact of the value of ninety kilogram force per meter square (90 kgf/sqm) due to movement of the first laboratory personnel on the floor 125 of the room 100.

The computer 220 determines a plurality of normal traffic patterns from the traffic data. In an embodiment, the computer 220 employs fractal-based pattern analysis to determine the traffic patterns. The fractal-based pattern analysis may include dimension reduction, predictive modeling, self-similar characteristics, association rules, clustering, classification, modeling and outlier discovery, selectivity estimation, spatial databases, R-trees, Quad-trees, model distributions, and/or the like for determining the plurality of normal traffic patterns from the traffic data.

The network 215 is in communication with the smart tiles 210 and the computer 220. In an embodiment, the network 215 is configured as a wireless network. Alternatively, the network 215 may be configured as a wired network. For example, the network 215 may be in communication either through cables, wires, optical fibers, or wireless with the smart tiles 210 and the computer 220. The network 215 may be selected from a local area network (LAN), wide area network (WAN), neural network, or the like.

In addition, the network 215 transmits the traffic data from the smart tiles 210 to the computer 220. For example, the network 215 may continuously transmit the traffic data from the smart tiles 210 to the computer 220 through optical fibers or wireless.

The network 215 may also provide a tool to model the traffic data into the plurality of normal traffic patterns. In a particular example, the network 215 configured as the neural network may comprise three (3) hidden layers in order to model the sets of traffic data sets. The neural network may employ eight (8) neurons in an input layer, twenty (20) neurons in each of the three (3) hidden layers, and one neuron in its output layer.

The network 215 configured as the neural network may be initially trained with a number of sets. The number of sets for training of the neural network may depend upon a steady state behavior of the data sets. An enhanced back propagation algorithm may be used to shorten training phase of the neural network.

The computer 220 detects an abnormal traffic pattern from the traffic data. For example, the computer 220 may detect the abnormal traffic pattern from the traffic data if the computer 220 determines a traffic pattern outside the plurality of predetermined normal traffic patterns.

The computer 220 activates a security response of the security module 205 in response to the abnormal traffic pattern. For example, in response to the abnormal traffic pattern i.e. the traffic pattern outside the plurality of predetermined normal traffic patterns, the computer 220 may activate the security response.

The security module 205 may comprise a lock. The lock may be disposed on the storage volume 110. The lock may be an automatic lock. In an embodiment, the security module 205 comprises a camera 115 that captures an area of an abnormal traffic for the security response. The camera 115 may the camera 115 of FIG. 1. The security module 205 may further comprise an alarm module 120. The alarm module 120 may be the alarm module 120 of FIG. 1.

The security module 205 provides the security response. For example, the security module 205 may provide the security response to the camera 115, the alarm module 120, the lock, and/or the like. In an embodiment, the security module 205 is configured to provide the security response of locking the storage volume 110.

In an embodiment, the lock denies access for the security response. For example, if the computer 220 detects the abnormal traffic pattern and activates the security response of locking the storage volume 110, the lock may deny access by locking the storage volume 110.

In one embodiment, the computer 220 is further configured to detect a prone individual from the traffic data. For example, the computer 220 may detect an injured individual, an unconscious individual, and/or the like from the traffic data.

Figure 3:
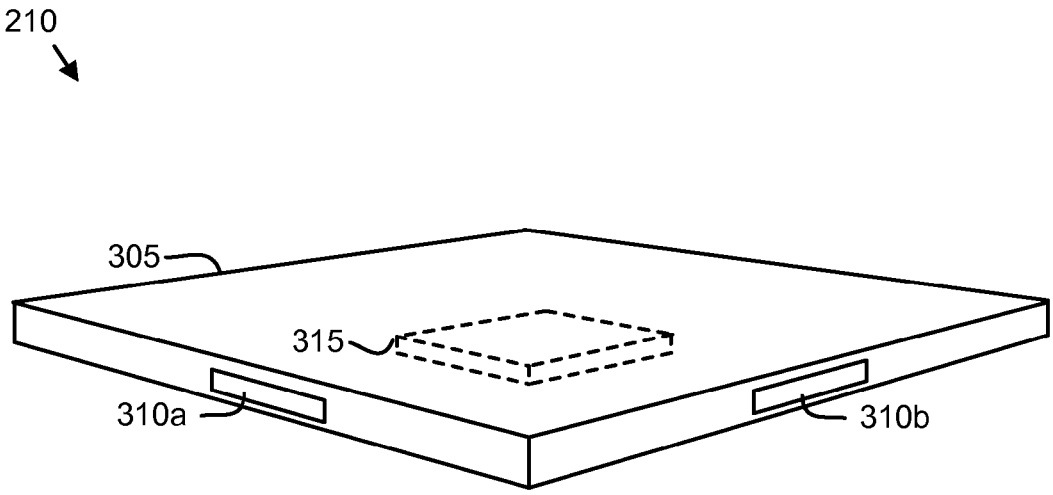
FIG. 3 is a perspective drawing diagram illustrating one embodiment of a smart tile of the present invention.

FIG. 3 is a schematic block diagram illustrating one embodiment of a smart tile 210 of the present invention. The security apparatus 200 of FIG. 2 includes the plurality of smart tiles 210. The smart tile 210 includes a smart tile surface 305, a plurality of interconnections 310*a-b*, and a sensing device 315. The description of smart tile 210 refers to elements of FIGS. 1-2, like numbers referring to like elements. Although for simplicity, only one sensing device 315 and two (2) interconnections 310*a-b* are shown, any number may be employed in the smart tile 210.

The smart tile 210 of FIG. 3 may also be embodied in the floor 125 of the room 100 of FIG. 1. The smart tile 210 may be manufactured from materials such as ceramics, plastic, wood, carpet, and/or any other suitable material. Although the smart tile 210 is shown substantially of square shape, one would appreciate that the smart tile 210 may be configured of any shape and configuration.

In an embodiment, the smart tile 210 comprises the sensing device 315. The sensing device 315 may be in communication with the smart tile surface 305. In an embodiment, the smart tile 210 comprises a strain gauge in communication with a polymer surface. For example, the smart tile surface 305 may be the polymer surface and the sensing device 315 may be the strain gauge. Continuing with the example, the smart tile surface 305 configured as the polymer surface may be in communication with the sensing device 315 configured as the strain gauge. In the shown embodiment, the sensing device 315 is laminated on a backside of the smart tile 210.

The smart tile surface 305 configured as the polymer surface may be capable of transferring changes in mechanical pressure from the smart tile surface 305 to the sensing device 315. The changes in mechanical pressure may be due to impact of one or more falling objects, laboratory personnel, and/or the like on the floor 125, impact of movement of feet of the laboratory personnel, carts and/or the like on the floor 125, and a weight of laboratory personnel, security personnel, carts, and/or the like on the floor 125.

The sensing device 315 configured as the strain gauge may measure each deformation of the smart tile surface 305 configured as the polymer surface. The strain gauge may be selected from a foil strain gauge, a piezoresistor, or the like.

The strain gauge may be in communication with one or more transducers (not shown). Each transducer may react to each deformation due to change in mechanical pressure in the smart tile surface 305. For example, when the smart tile surface 305 is deformed due to pressure of a shoe, a bare foot, or the like of a person walking on the plurality of smart tiles 210, the plurality of transducers may convert each deformation into an electrical signal of certain volts. The greater is the deformation the greater may be the electrical potential of the electrical signal.

Each transducer may include piezoelectric or piezo-polymers such as polyvinylidene fluoride (PVDF), lead zirconate titanate polyparaxylene, poly-bischloromethyuloxetane, aromatic polyamides, polysulfone, polyvinyl fluoride, synthetic polypeptide cyanoethul cellulose or the like. For example, the piezo-polymer such as PVDF may transform each deformation in smart tile surface 305 into the electrical signal.

The plurality of interconnections 310*a-b* may connect the plurality of transducers to the network 215 and hence in turn may connect the smart tile 210 to the computer 220 and a power supply. The plurality of interconnections 310*a-b* may also interconnect the plurality of smart tiles 210 among each other. Alternatively, the smart tile 210 may comprise a wireless transmitter. The wireless transmitter may transmit the traffic data to the computer 220 over a wireless network. The wireless transmitter may be embedded in the sensing device 315.

The schematic flow chart diagrams that follow are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 4:
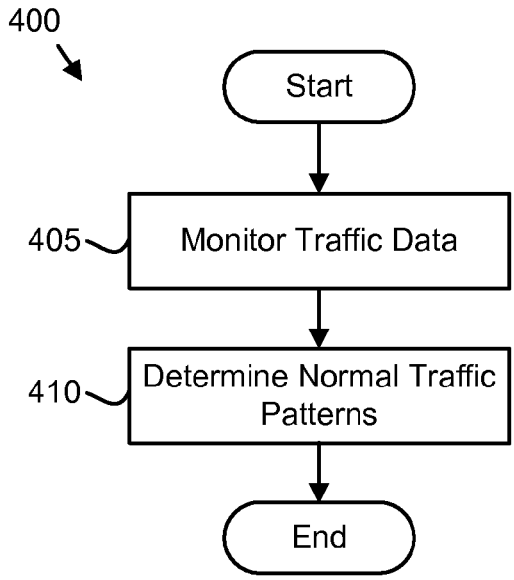
FIG. 4 is a schematic flow chart diagram illustrating one embodiment of a method for determining normal traffic patterns of the present invention.

FIG. 4 is a schematic flow chart diagram illustrating one embodiment of a method 400 for determining normal traffic patterns of the present invention. The method 400 substantially includes the steps to carry out the functions presented above with respect to the operation of the described room 100 of FIG. 1, security apparatus 200 of FIG. 2, and smart tile 210 of FIG. 3. The description of method 400 refers to elements of FIGS. 1-3, like numbers referring to like elements. In one embodiment, the method 400 is implemented with a computer program product comprising a computer readable medium having a computer readable program. The computer readable program may be integrated into the computer 220 of the security apparatus 200 of FIG. 2.

The method 400 begins, and in an embodiment, the plurality of smart tiles 210 configured to monitor 405 the traffic data. In an embodiment, the traffic data comprises data sets of positions, rates, and times. Each data set may further comprise a weight and an impact. For example, each sensing device 315 of the plurality of smart tiles 210 may automatically measure each deformation due to each change in mechanical pressure of each smart tile surface 305 to monitor 405 the traffic and the plurality of transducers may automatically convert each sensed deformation into an electrical signal to generate the traffic data. In one embodiment, the plurality of smart tiles 210 convert the electric signal to one or more digital values.

The network 215 transmits the traffic data from the plurality of smart tiles 210 to the computer 220. For example, the network 215 may transmit the traffic data through cables, wires, or through one or more wireless transmitters.

The computer 220 determines 410 the plurality of normal traffic patterns from the traffic data. The computer 220 may employ fractal-based pattern analysis to determine the traffic patterns. For example, the computer 220 may initially train itself by employing one or more techniques such as dimension reduction, predictive modeling, self-similar characteristics, association rules, clustering, classification, and the like of the fractal-based pattern analysis to determine 410 the plurality of normal traffic patterns from the traffic data.

Alternatively, the computer 220 may determine 410 a data set comprising a plurality of relative positions of laboratory personnel, carts, and/or the like moving and/or stacked and a plurality of rate of movements of laboratory personnel, carts, and/or the like moving and/or stacked, and the impact and weight of the laboratory personnel, carts, and/or the like moving and/or stacked on a fixed portion of area of the floor 125 as the normal traffic patterns. The laboratory personnel may be trained to recognize and use the fixed portion of the area of the floor 125 to for access CNBRE materials for normal functioning.

Figure 5:
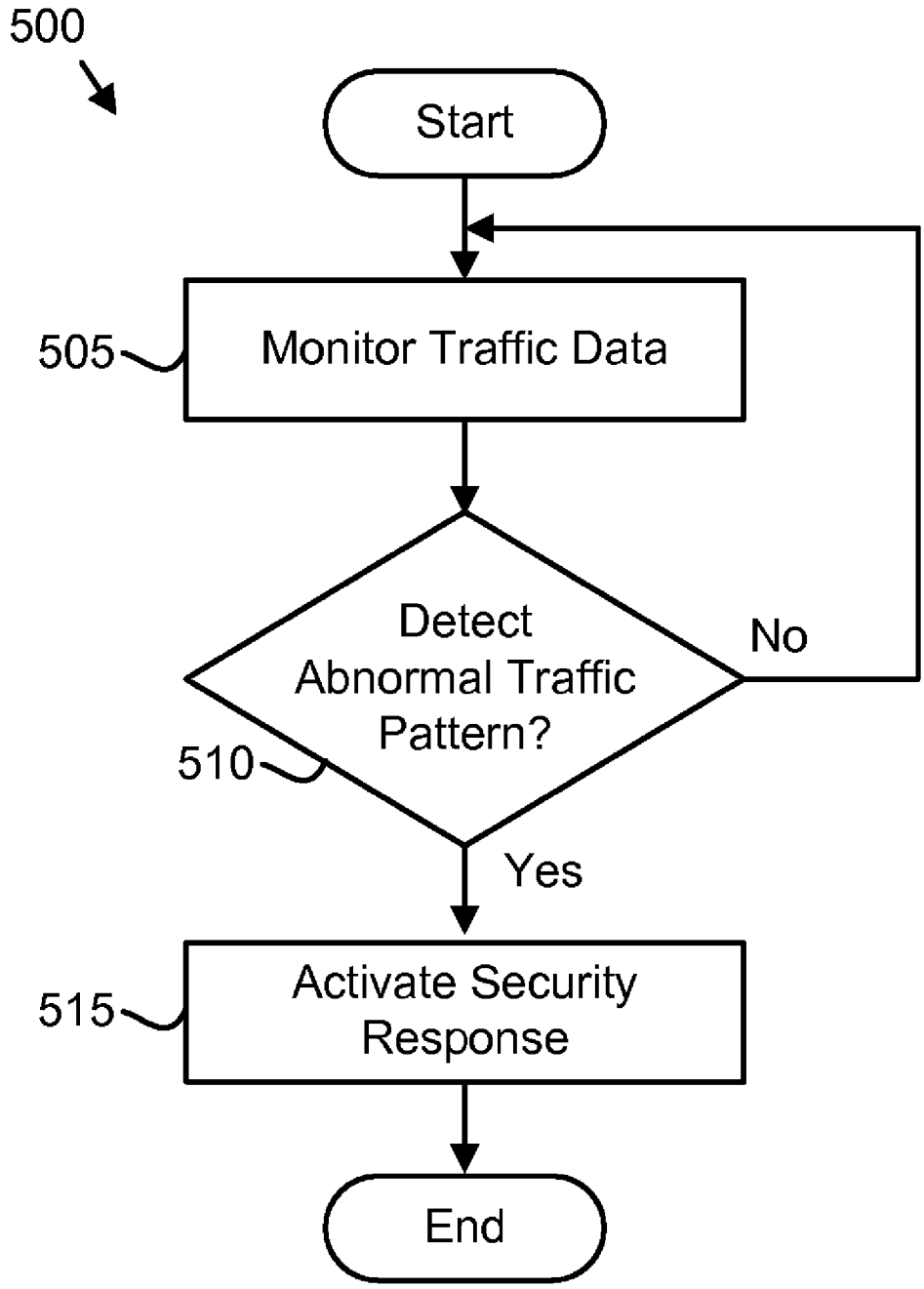
FIG. 5 is a schematic flow chart diagram illustrating one embodiment of a method for safely and securely storing CNBRE materials by activating a security response of the present invention.

FIG. 5 is a schematic flow chart diagram illustrating one embodiment of a method 500 for safely and securely storing materials by activating a security response of the present invention. The method 500 substantially includes the steps to carry out the functions presented above with respect to the operation of the described room 100 of FIG. 1, security apparatus 200 of FIG. 2, smart tile 210 of FIG. 3, and method 400 of FIG. 4. The description of method 500 refers to elements of FIGS. 1-4, like numbers referring to like elements. In one embodiment, the method 500 is implemented with a computer program product comprising a computer readable medium having a computer readable program. The computer readable program may be integrated into the computer 220 of security apparatus 200 of FIG. 2.

The method 500 begins, and in an embodiment, the computer 220 monitors 505 the traffic data. For example, the computer 220 may automatically monitor 505 the traffic data sensed and generated 405 by the plurality of smart tiles 210 configuring the floor 125 of the room 100 used for storing CNBRE materials.

The computer 220 detects 510 if there is an abnormal traffic pattern from the traffic data. For example, the computer 220 may detect 510 a traffic pattern outside the predetermined normal traffic patterns as the abnormal traffic pattern.

In one more embodiment, the computer 220 detects 510 a prone individual from the traffic data. For example, the computer 220 may detect 510 an injured individual, an unconscious individual, and/or the like from the traffic data by detecting 510 the data sets comprising the impact and weight of the injured individual, the unconscious individual, and/or the like as the abnormal traffic pattern.

If the computer 220 detects 510 that there is no abnormal traffic pattern from the traffic data, the computer 220 may further monitor 505 the traffic data. In response to the abnormal traffic pattern from the traffic data, the security module 205 activates 515 the security response. For example, in response to the traffic pattern outside the normal traffic pattern from the traffic data, the security module 205 may automatically initiate one or more signals to activate 515 the security response.

The security response may be for the camera 115, the alarm module 120, and/or the lock. For example, response to the abnormal traffic pattern from the traffic data, the security module 205 may activate 515 the security response by initiating one or more signals for the one or more speakers to announce security concerns, for the one or more display screens to flash security concerns, for the camera 115 to capture the video and/or photograph of the area of the abnormal traffic, and/or for the lock to deny access to the storage volume 110. Thus, the method 400 and the method 500 combined together would allow storing of CNBRE materials in the laboratory environment safely and securely by employing the plurality of smart tiles 210.

Figure 6:
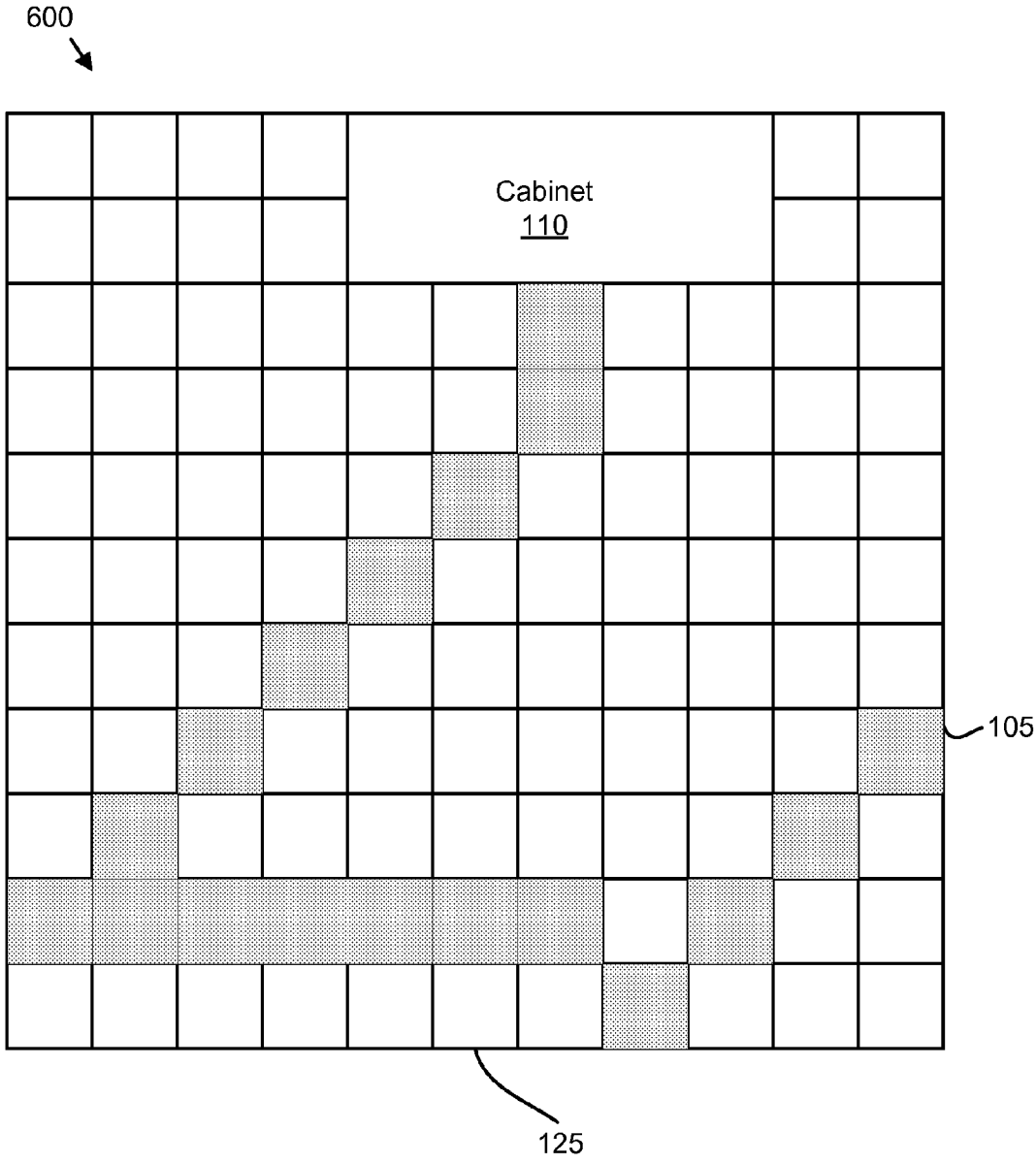
FIG. 6 is a schematic drawing illustrating one embodiment of normal traffic patterns of the present invention.

FIG. 6 is a schematic drawing illustrating one embodiment of normal traffic patterns 600 of the present invention. The description of the normal traffic patterns 600 refers to elements of FIGS. 1-5, like numbers referring to like elements. The normal traffic patterns 600 include the floor 125, the door 105, and the storage volume 110.

In the shown embodiment, the floor 125 is covered with the plurality of smart tiles 210. Some smart tiles 210 of the plurality of smart tiles 210 are shown shaded to indicate traffic.

The computer 220 may determine 410 the traffic data comprising the plurality of data sets with the plurality of relative positions of laboratory personnel, carts, and/or the like that are sensed and generated 405 by the plurality of shaded smart tiles 210 of FIG. 6 are the normal traffic patterns 600. The security module 205 may not activate the security response for the normal traffic patterns 600. A person that wishes an access to CNBRE materials may be trained to follow a route as shown by the shaded smart tiles 210 from the door 105 to the storage volume 110 for normal functioning of the laboratory.

Figure 7:
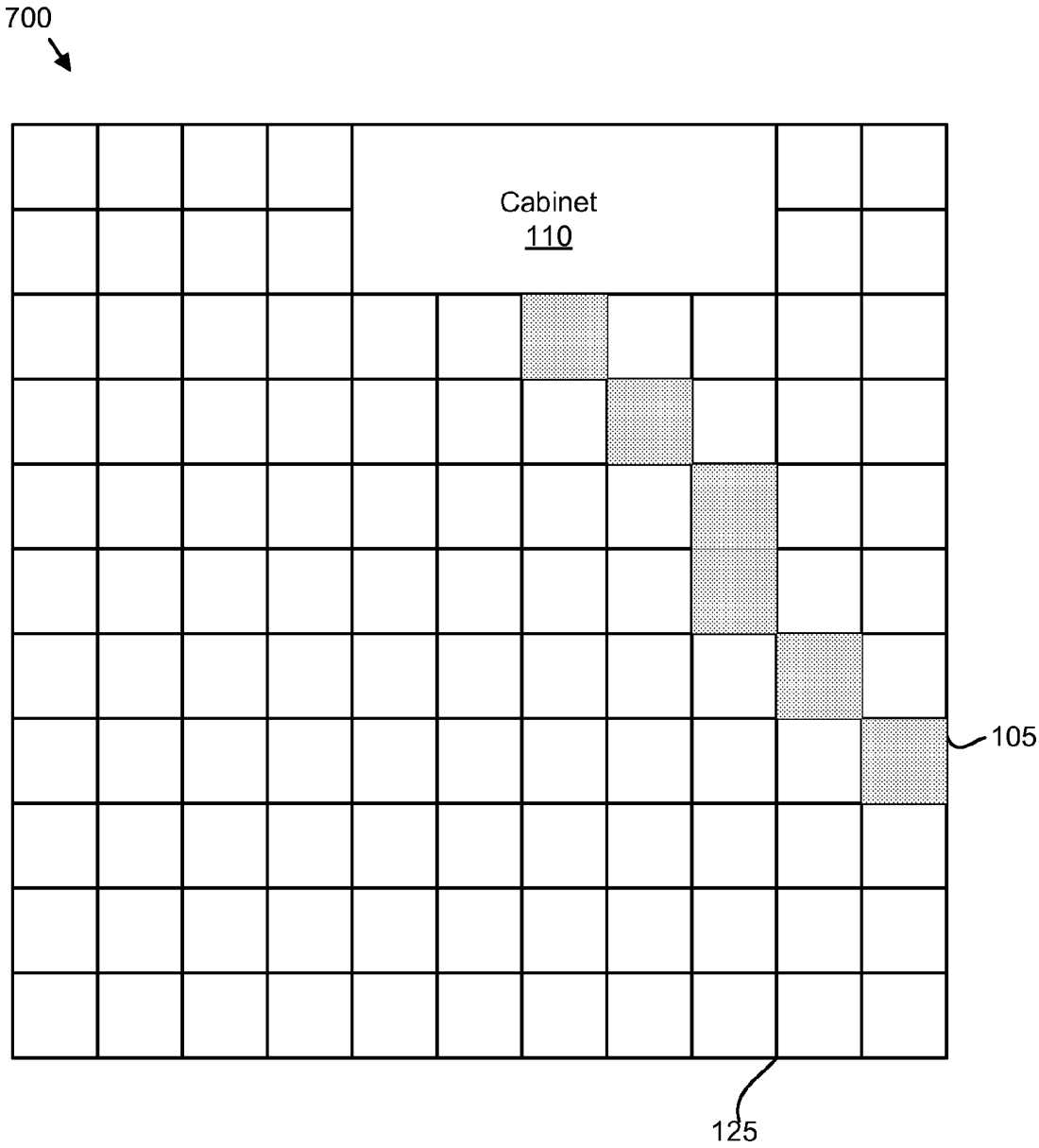
FIG. 7 is a schematic drawing illustrating one embodiment of abnormal traffic patterns of the present invention.

FIG. 7 is a schematic drawing illustrating one embodiment of abnormal traffic patterns 700 of the present invention. The description of the abnormal traffic patterns 700 refers to elements of FIGS. 1-6, like numbers referring to like elements. The abnormal traffic patterns 700 include the floor 125, the door 105, and the storage volume 110.

In the shown embodiment, the floor 125 is covered with the plurality of smart tiles 210. Some of the smart tiles 210 of the plurality of smart tiles 210 are shown shaded to indicate traffic on the plurality of smart tiles 210.

The computer 220 may detect 510 the traffic data generated 405 by the plurality of shaded smart tiles 210 of FIG. 7 as the abnormal traffic patterns 700. In response to the abnormal traffic patterns, the security module 205 may activate 515 the security response.

For example, an unauthorized person may follow a route from the door 105 to the storage volume 110 for accessing CNBRE materials shown by the shaded smart tiles 210 of FIG. 7. Continuing with the example, the computer 220 may detect 510 the traffic data from the plurality of shaded smart tiles 210 of FIG. 7 as an abnormal traffic patterns. The security module 205 may activate 515 the security response for the camera 115, lock, alarm module 120, and the camera 115. On receiving the security response, the alarm module 120 may raise audio-visual alarm, the camera 115 may capture the video and/or photograph of the affected area, and the lock may deny access to the storage volume 110 that stores the CNBRE materials.

In an alternate embodiment, the invention may be practiced with a grid of strain gauges woven into a carpet. The grid of strain gauges may also be woven into a carpet liner. In a certain embodiment, the grid of strain gauges may be placed under the carpet and/or the carpet liner. The grid may be visually undetectable. The computer 220 may monitor 505 the traffic patterns generated by the grid of strain gauges that are in communication with the carpet and/or carpet liner and detect 510 abnormal traffic patterns.

The present invention provides an apparatus, a system, and a method for safely and securely storing materials. Beneficially such an apparatus, system, method would allow for example, the door to a laboratory to be left open to preserve line of sight safety while protecting CNBRE materials. Additionally, the apparatus, system, and method would support visual spotting an injured person and allow one or more rescuing staff members to enter a laboratory area to rescue the injured person, reduce restrictions to access areas of the laboratory due to lockable doors, and immediately lock a storage volume storing CNBRE materials in case of any failure of a security system. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for security and safety, the apparatus comprising:
   - a security module configured to provide a security response;
   - a plurality of smart tiles configured to sense traffic and generate traffic data;
   - a network in communication with the smart tiles and a computer and configured to transmit the traffic data from the smart tiles to the computer; and
   - the computer configured to determine a plurality of normal traffic patterns from the traffic data using dimension reduction fractal-based pattern recognition, detect a prone individual from an abnormal traffic pattern outside of the plurality of normal traffic patterns from the traffic data, and activate the security response in response to the abnormal traffic pattern.

2. The apparatus of claim 1, wherein the smart tile comprises a sensing device in communication with a smart tile surface.

3. The apparatus of claim 2, wherein the smart tile comprises a strain gauge in communication with a polymer surface.

4. The apparatus of claim 1, wherein the smart tile comprises a strain gauge grid in communication with a carpet.

5. The apparatus of claim 1, wherein the traffic data comprises data sets each with a position, a rate, and a time.

6. The apparatus of claim 5, wherein the data sets each further comprise a weight and an impact, the abnormal traffic pattern indicates the prone individual, and the data sets comprise an impact and a weight of the prone individual.

7. The apparatus of claim 1, wherein the network is configured as a wireless network and each smart tile further comprises a wireless transmitter.

8. The apparatus of claim 1, wherein the network is a wired network and the smart tiles further comprise interconnections.

9. The apparatus of claim 1, wherein the computer employs fractal-based pattern analysis to determine the traffic patterns.

10. The apparatus of claim 1, wherein the security module comprises a lock that denies access for the security response.

11. The apparatus of claim 1, wherein the security module further comprises an alarm module configured to communicate an alarm message for the security response.

12. The apparatus of claim 1, wherein the security module comprises a camera that captures an area of the abnormal traffic for the security response.

13. A computer program product comprising a computer useable medium having a computer readable program stored on a tangible storage device, wherein the computer readable program when executed on a computer causes the computer to:

generate traffic data from a plurality of smart tiles configured to sense traffic;

transmit the traffic data from the smart tiles;

determine a plurality of normal traffic patterns from the traffic data using dimension reduction fractal-based pattern recognition;

detect a prone individual from an abnormal traffic pattern outside of the plurality of normal traffic patterns from the traffic data; and activate a security response in response to the abnormal traffic pattern.

14. The computer program product of claim 13, wherein the traffic data comprises data sets of positions, rates, and times.

15. The computer program product of claim 14, wherein the data sets each further comprise a weight and an impact, the abnormal traffic pattern indicates the prone individual, and the data sets comprise an impact and a weight of the prone individual.

16. The computer program product of claim 13, wherein the computer readable program is further configured to employ fractal-based pattern analysis to determine the traffic patterns.

17. A system for security and safety, the system comprising:

a storage volume;

a security module comprising a lock disposed on the storage volume and configured to provide a security response of locking the storage volume;

a plurality of smart tiles each comprising a strain gauge in communication with a polymer surface and configured to sense traffic and generate traffic data, the traffic data comprising data sets each with a position, a rate, and a time;

a network in communication with the smart tiles and a computer and configured to transmit the traffic data from the smart tiles to the computer; and the computer configured to determine a plurality of normal traffic patterns from the traffic data using dimension reduction fractal-based pattern recognition, detect a prone individual from an abnormal traffic pattern outside of the plurality of normal traffic patterns from the traffic data, and activate the security response in response to the abnormal traffic pattern.

18. The system of claim 17, wherein the network is configured as a wireless network and each smart tile further comprises a wireless transmitter, the traffic data comprises data sets each with a position, a rate, a time, a weight, and an impact, the abnormal traffic pattern indicates the prone individual, and the data sets comprise an impact and a weight of the prone individual.

19. A method for deploying computer infrastructure, comprising integrating a computer readable program stored on a tangible storage device into a computing system, wherein the program in combination with the computing system is capable of:

generating traffic data from a plurality of smart tiles configured to sense traffic, the traffic data comprising sets each with a position, a rate, a time, a weight, and an impact;

transmitting the traffic data from the smart tiles over a wireless network;

determining a plurality of normal traffic patterns from the traffic data using fractal-based pattern analysis;

detecting an abnormal traffic pattern outside of the plurality of normal traffic patterns from the traffic data, wherein the traffic data comprises data sets each with a position, a rate, a time, a weight, and an impact, the abnormal traffic pattern indicates a prone individual, and the data sets comprise an impact and a weight of the prone individual; and activating a security response at a security module in response to the abnormal traffic pattern.

* * * * *